United States Patent [19]

Civitelli

[11] Patent Number: 4,858,273

[45] **Date of Patent: * Aug. 22, 1989**

[54] DOOR STOP HAVING MULTIPLE MOUNTING POSITIONS

[76] Inventor: Gennaro Civitelli, 336 Mountain Rd., Hamden, Conn. 06514

[ * ] Notice: The portion of the term of this patent subsequent to Jul. 9, 2002 has been disclaimed.

[21] Appl. No.: 724,615

[22] Filed: Apr. 18, 1985

Related U.S. Application Data

[63] Continuation of Ser. No. 532,601, Sep. 15, 1983, Pat. No. 4,527,303.

[51] Int. Cl.[4] ..... E05D 3/06; E05D 11/06

[52] U.S. Cl. ..... 16/86 A; 16/86 B; 16/236; 16/239; 16/366; 16/DIG. 39; 403/4

[58] Field of Search ..... 16/82, 85, 86 R, 86 A, 16/86 B, 86 C, 221, 223, 236, 237, 239, 365, 366, 375, 387, DIG. 39; 403/3, 4

[56] References Cited

U.S. PATENT DOCUMENTS

| | | | |
|---|---|---|---|
| 27,788 | 4/1860 | Fayman | 16/387 |
| 670,120 | 3/1901 | Van Tuyl | 403/4 X |
| 2,638,620 | 5/1953 | Civitelli | 16/375 |
| 2,813,293 | 11/1957 | Civitelli | 16/86 B |
| 2,839,779 | 6/1958 | Haag . | |
| 3,135,012 | 6/1964 | Wessel | 16/86 B X |
| 3,174,179 | 3/1965 | Benson . | |
| 4,259,762 | 4/1981 | Civitelli | 16/86 B |
| 4,527,303 | 7/1985 | Civitelli | 16/86 B |

*Primary Examiner*—Fred A. Silverberg

*Attorney, Agent, or Firm*—St. Onge, Steward, Johnston & Reens

[57] ABSTRACT

A door stop for mounting on a hinge pin of a hinged door is disclosed and comprises a body including at one end portion thereof at least two apertures for receiving the hinge pin. Two bumpers are secured with respect to said body, each bumper being spaced from the other bumper and the axis of each aperture to define one angle between one aperture axis and the bumpers and another angle between another aperture axis and the bumpers to provide for multiple mounting positions of the door stop on the hinge pin.

6 Claims, 7 Drawing Sheets

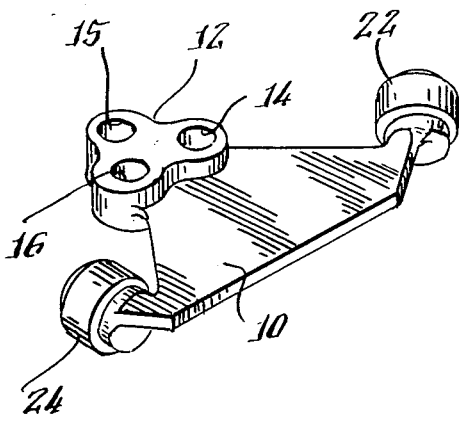
Fig. 1.
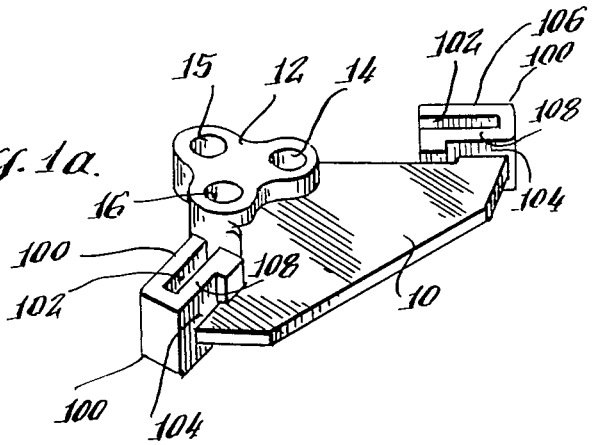
Fig. 1a.
Fig. 2.
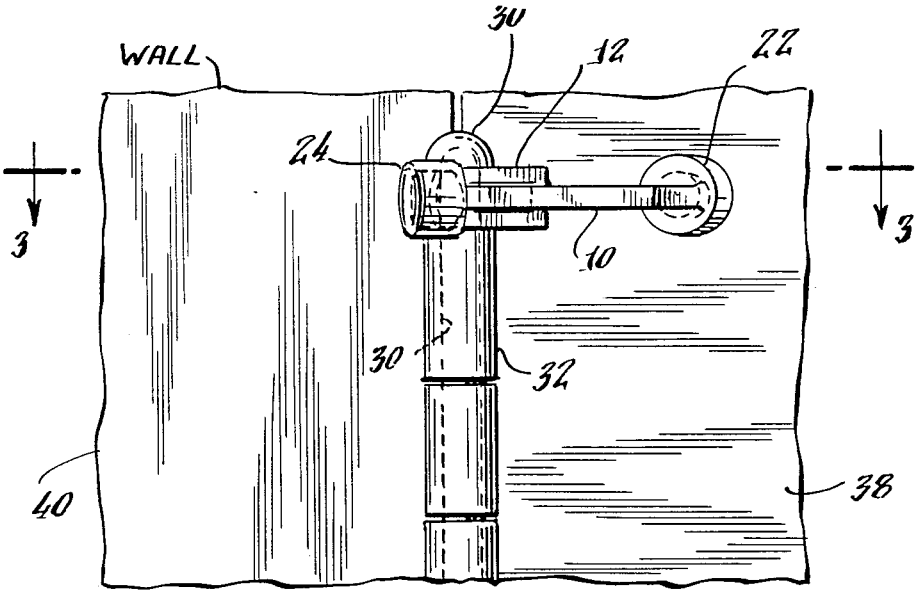

DOOR STOP HAVING MULTIPLE MOUNTING POSITIONS

This is a continuation of co-pending application Ser. No. 532,601 filed on Sept. 15, 1983, now U.S. Pat. No. 4,527,303.

BACKGROUND OF THE INVENTION (1) Field of the Invention

The present invention relates to door stops, and more particularly, door stops of the type which are mounted on the hinge pin of a door and prevent the door from being forced against an adjacent wall when it is opened.

(2) Description of the Prior Art

It is desirable to provide a door stop which is mounted on the hinge pin of a conventional hinge and which prevents the door from being opened to an angle where it contacts an adjacent wall or door. Door stops of this type are typically adjustable to provide for placement on doors having different door and door jam constructions. It is also known that a conventional hinge pin protrudes outwardly from the door a varying distance depending upon how it is installed and the door construction. Numerous prior art door stops have been proposed which are adjustable to accomodate various types of door construction. More specifically, many of the prior art door stops have a single aperture which receives the hinge pin and two arms protruding outwardly from the aperture each having thereon a bumper for contacting the door and the door jam. Such door stops are disclosed in the following U.S. Patents:

| U.S. Pat. No. | Inventor |
|---|---|
| 2,638,620 | Civitelli |
| 2,813,293 | Civitelli |
| 2,839,779 | Haag |
| 3,135,012 | Wessel |
| 3,174,179 | Benson |
| 4,259,762 | Civitelli |

Each of the foregoing patents discloses that the bumpers are adjustable with respect to each other and the aperture about which the door stop pivots to provide for use of the door stop on various door configurations. Although some of these types of door stops have proven to be useful, they are relatively expensive to manufacture because they involve numerous parts, typically which require machining and other manufacturing steps.

It is an object of the present invention to provide a door stop that is useful on various types of door constructions, but which may be manufactured simply and inexpensively.

As another object of the present invention, in one embodiment, it is desirable to provide a single piece door stop construction which has no movable parts, and which may be formed in a single molding or stamping operation.

SUMMARY OF THE INVENTION

In accordance with the present invention, a door stop for mounting on a hinged pin of a hinged door is provided and comprises a body including at least two apertures for receiving the hinge pin, each aperture having an axis about which the body pivots when the body is mounted on the pin. At least two bumpers are mounted on said body, and each bumper is spaced from the other bumper and each of the aperture axes to thereby define one angle between one said axis and said bumpers, and another angle between the other axis and the bumpers. By positioning the hinge pin in one or the other aperture, a suitable angle for a particular door may be selected.

In one embodiment of the invention, one bumper is spaced a greater distance from the axis of one aperture than the other bumper, that is, the bumpers are not equal distance from the point about which the body of the door pivots. In a case where the door jam includes tapered molding, which is not atypical, by turning over the door stop, an additional door angle is obtained for each aperture.

In one embodiment of the invention, the door stop includes three apertures for receiving the hinge pin. The angle between the bumpers and the axis of each aperture provides for three settings on each side of the door stop. If the door stop is turned over, three additional settings are provided. Thus, with a door stop having three apertures, it has been found that the permutations of positioning enable a door stop in accordance with present invention to be used with a wide variety of doors.

A door stop in accordance with the present invention has several advantages over the prior art door stops. Because it is made from a single piece, it is relatively easy to manufacture in comparison with prior art door stops comprising numerous parts. A door stop in accordance with the present invention may be molded from a plastic material, cut from wood, or die stamped from metal such as aluminum or stainless steel or other metals, and once properly positioned on the hinge pin, functions as well or better than prior art door stops. More particularly, prior art door stops which are adjustable may loosen during use and repeated force of the door against the door stop may alter the adjusted angle. In the case of a door stop in accordance with the present invention, the door stop maintains its angle throughout use.

DETAILED DESCRIPTION OF THE DRAWINGS

FIG. 1 is a perspective view of one embodiment of a door stop in accordance with the present invention;

FIG. 1A shows a plan view of an alternative embodiment of the invention wherein the bumper is integrally formed with the body of the door stop;

FIG. 2 is a side view of the door stop shown in FIG. 1 secured to a hinge pin of a door hinge;

DETAILED DESCRIPTION OF THE INVENTION

Figure 3:
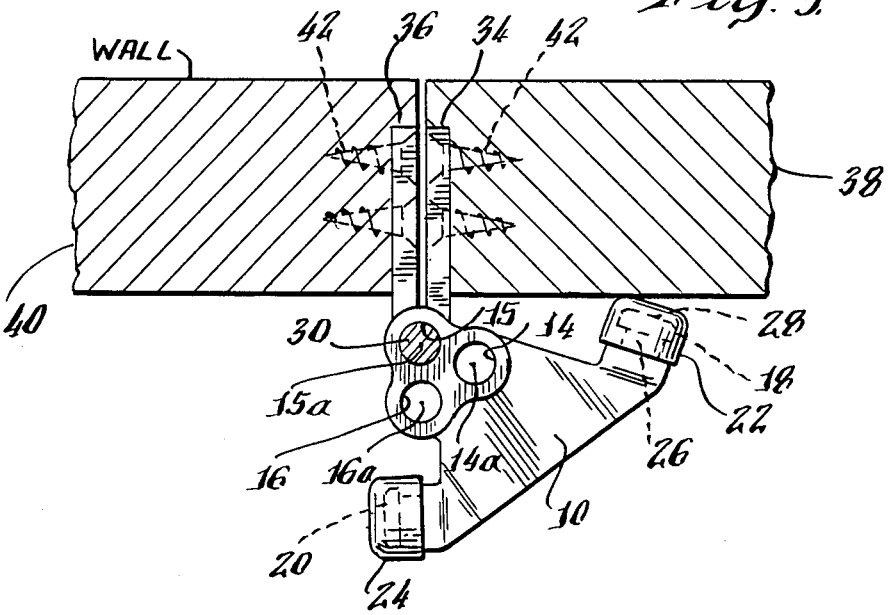
FIG. 3 is a sectional view along the line 3—3 of FIG. 2.

Referring to FIGS. 1–4, a door stop in accordance with the present invention is shown. The door stop comprises a body 10 including at one end portion 12 a series of three apertures 14, 15 and 16 each having a respective pivot axis 14*a*, 15*a* and 16*a* (see FIG. 3).

At two locations spaced from the apertures 14, 15 and 16, the body 10 includes protrusions 18 and 20 on which are mounted bumpers 22 and 24. The protrusions 18 and 20 may have various configurations, although it is preferred that the protrusions have a cylindrical section 26 which extends outwardly from body 10 and a button-like cap 28. The bumper is molded from elastomeric material such as rubber or other synthetic material so that it fits over the protrusion 18 and engages the underside of the button 28 to maintain the bumper in place.

Referring to FIG. 1A, an alternative embodiment of the invention is shown wherein the bumper is integrally formed with the body 10 of the door stop. The body 10 is made from resilient plastic. The bumper 100 includes at least one and preferably two or more elongate spaces 102 and 104 which permit solid portions 106 and 108 to flex inwardly when the bumper impacts a door or door-jamb. The space 102 is open at one side of said bumper and space 104 is open at another side of said bumper to form an S-shaped coil that compresses on impact. The integral bumper in FIG. 1A is shown as an example, and, it should be understood that other designs for an integral bumper may be used.

Figure 4:
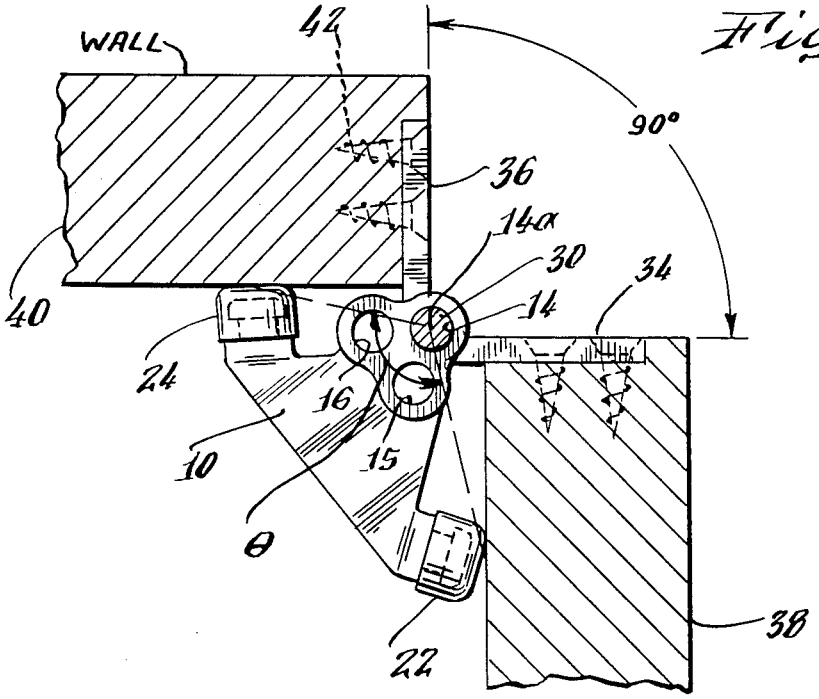
FIG. 4 is a view similar to that shown in FIG. 3 except that the door has been opened 90 degrees and the door stop prevents further opening.
Figure 5:
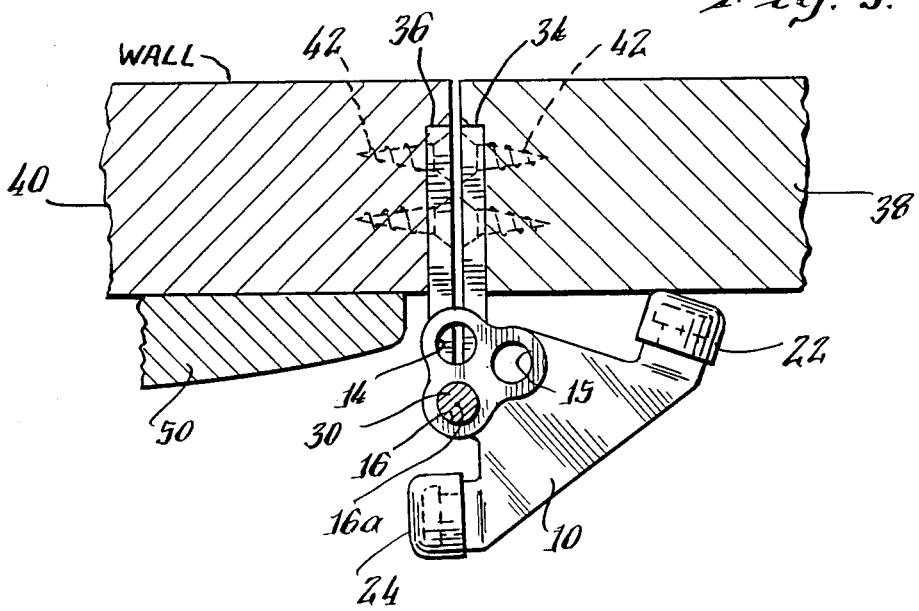
FIG. 5 shows a wall and door similar to that shown in FIG. 3 with the exception that the wall includes a tapered molding which alters the angle between the door and the wall. The door stop as shown in FIG. 1 is positioned on the hinge in a different aperture.
Figure 6:
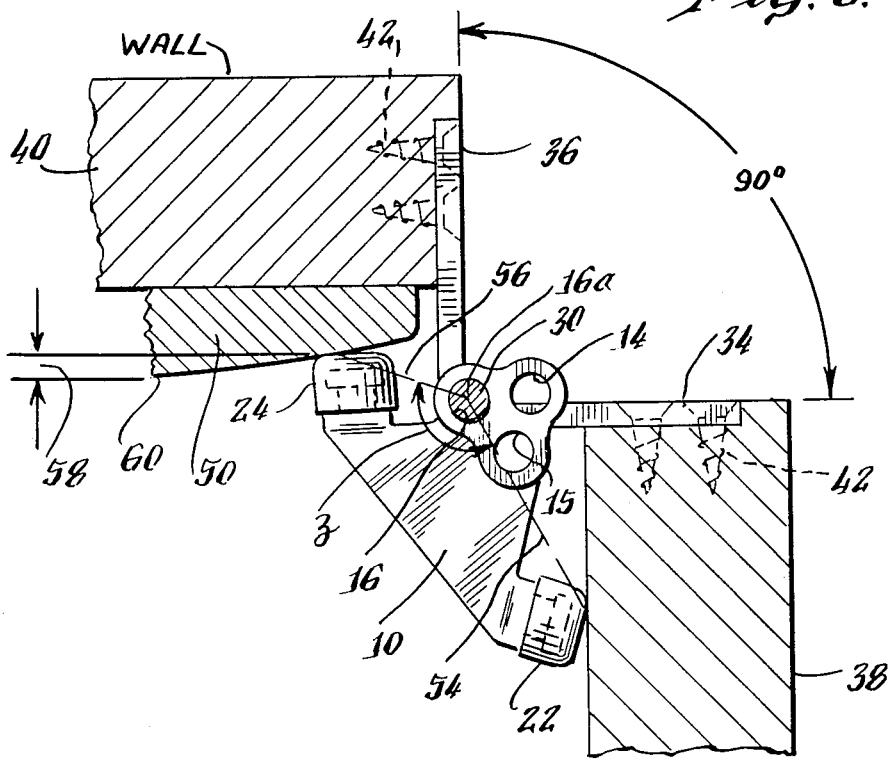
FIG. 6 shows the door shown in FIG. 5 open to 90 degrees with the door stop preventing further opening.

Referring in particular to FIGS. 2 and 3, the door stop is mounted on the pin 30 of hinge 32. The hinge plates 34 and 36 are attached respectively to door 38 and wall 40 by a series of screws 42. In the embodiment shown in FIGS. 1 through 4, the door is intended to open 90 degrees. In the case where the doors have a relatively flat surface with no external molding, the door stop is mounted on hinge pin 30 through aperture 15. Thus, the door stop as shown in a comparison between FIGS. 3 and 4 pivots about axis 15*a*. Each bumper is spaced from the other bumper and each of the aperture axis, for each aperture, an angle is defined between the axis and the bumpers. More specifically, as shown in FIG. 4, an angle of theda is defined between bumpers 22, 24 and axis 14*a* about which the door stop pivots. Referring to FIGS. 5 and 6, these figures are identical to FIGS. 3 and 4 respectively with the exception that a tapered molding 50 is added to the wall and the hinge pin 30 is located a further distance from the wall and the door, i.e. the hinge plate 34 and 36 extend outwardly further and the hinge pin 30 is located in a different position. By a trial and error method, the door stop is positioned in aperture 16, which as shown in FIG. 6 provides an angle of z between axis 16*a* and bumpers 22 and 24.

Figure 7:
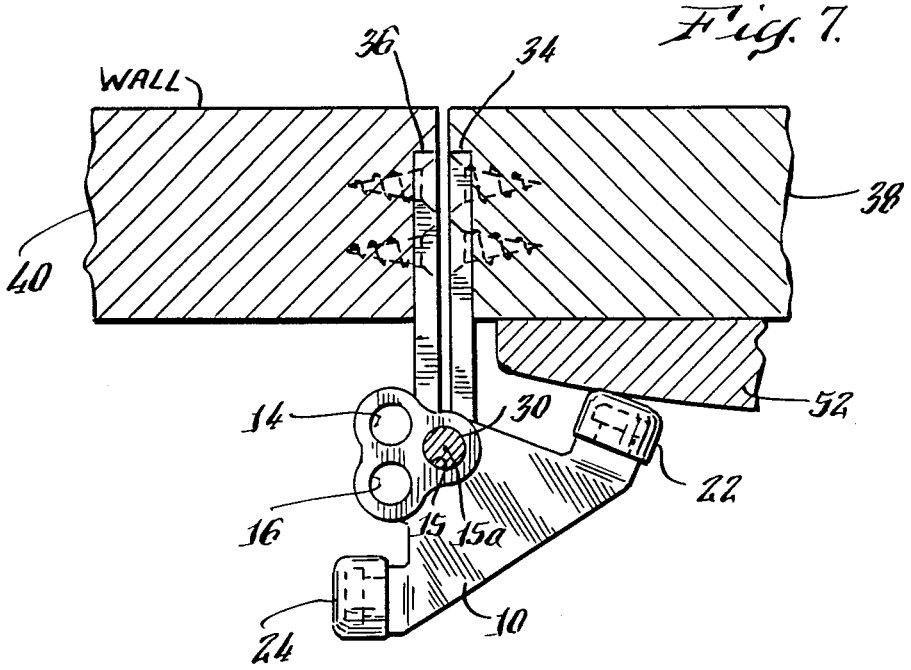
FIG. 7 shows a door stop as shown in FIG. 1 mounted on a door having tapered molding and wherein the door stop is installed on the hinge pin by mounting the pin in the third aperture.
Figure 8:
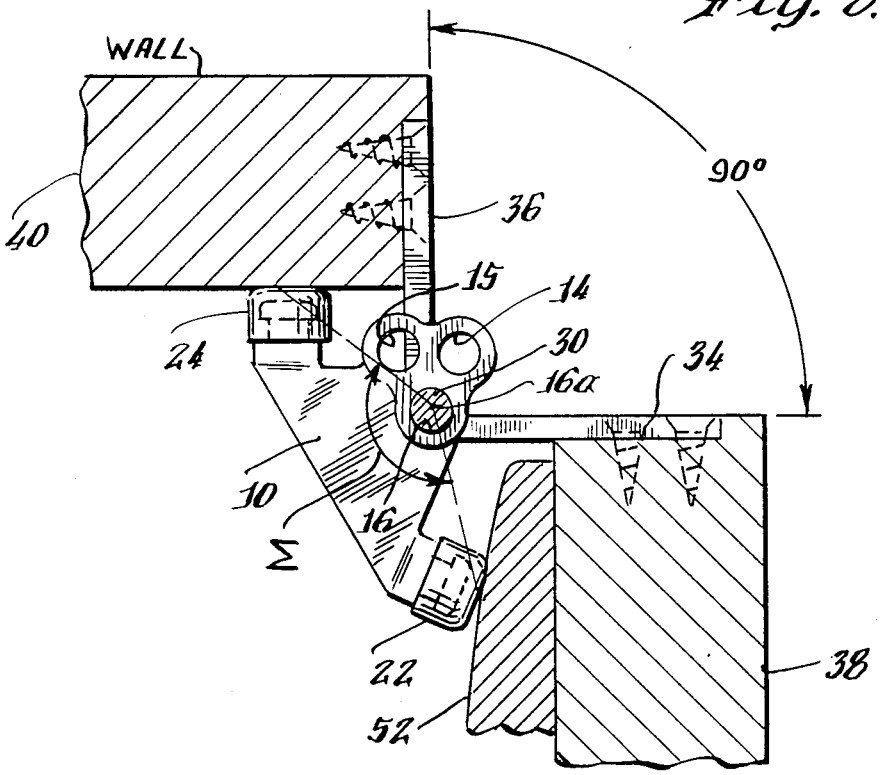
FIG. 8 shows the door shown in FIG. 7 open 90 degrees with the door stop preventing further movement.
Figure 9:
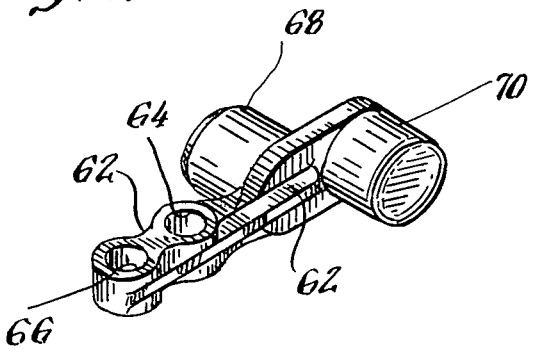
FIG. 9 shows another embodiment of a door stop for use in permitting a door to open approximately 180 degrees.

Similarly, FIGS. 7 and 8 show another embodiment of a wall and door construction wherein tapered molding 52 is placed on the door 38 rather than a wall 40. In this instance, the hinge pin 30 is mounted on aperture 15*a* to define an angle sigma between the axis 16*a* and bumpers 22 and 24. As can be appreciated by viewing FIGS. 3 through 8, by positioning the hinge pin 30 in various apertures, 14, 15 or 16, the door stop in accordance with the present invention may be used on various types of door and wall constructions. By a trial and error method, or through experience of the door stop installer, the door stop may be located with the hinge pin in the most appropriate hole to provide the desired angle between the open door and the wall. Thus, as shown in FIGS. 3–8, at least three different angles are provided.

Referring to FIGS. 5 and 6, in particular FIG. 6, it is noted that the distance between axis 16*a* and bumper 22, as indicated at reference character 54, is greater than the distance between axis 16*a* and bumper 24 as indicated at reference character 56. Because the molding 50 is tapered, if the door stop shown in FIG. 6 were to be removed and turned over and reinstalled, a different angle between the wall 40 and the door 38 would be provided. More specifically, while the angle between bumpers 22 and 24 and the axis 16*a* would remain the same, bumper 22 would contact the surface of tapered molding 50 at a distance from the underlying wall greater than the point at which bumper 22 would strike the tapered molding. Referring to FIG. 6, this distance is indicated at reference character 58 because the bumper 22 if the door stop were turned over would strike at approximately point 60 on the wall. As can be well appreciated, for each aperture, the distance between the aperture axis and bumper 24 differs from the distance between the same aperture axis and bumper 22. In the case where there are irregularities on the wall and/or the door, by turning over the door stop, three additional settings for the door stop are provided. Thus, in a door stop in accordance with the present invention, there are a sufficient number of settings so that the door stop accomodates most typical door and wall constructions.

As can be well appreciated, the body 10 of the door stop can be molded out of plastic in a single step operation. Alternatively, the body 10 could be made from wood or metal such as aluminum, steel, or other metals. By providing a relatively simple, single piece body, the manufacturing and material costs of the door stop can be reduced significantly from the costs of prior art adjustable type door stops.

Figure 10:
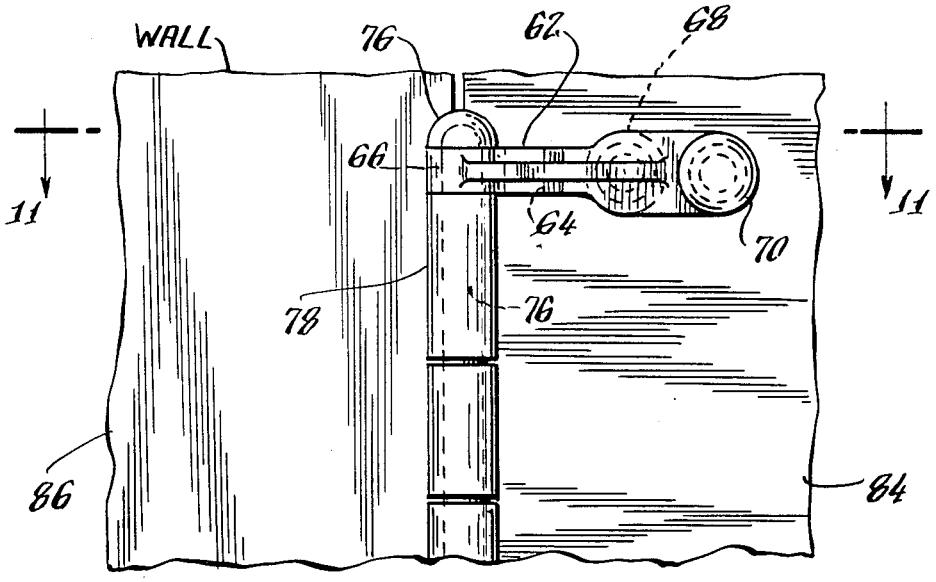
FIG. 10 shows the door stop of FIG. 9 installed on a hinge pin of a door.
Figure 11:
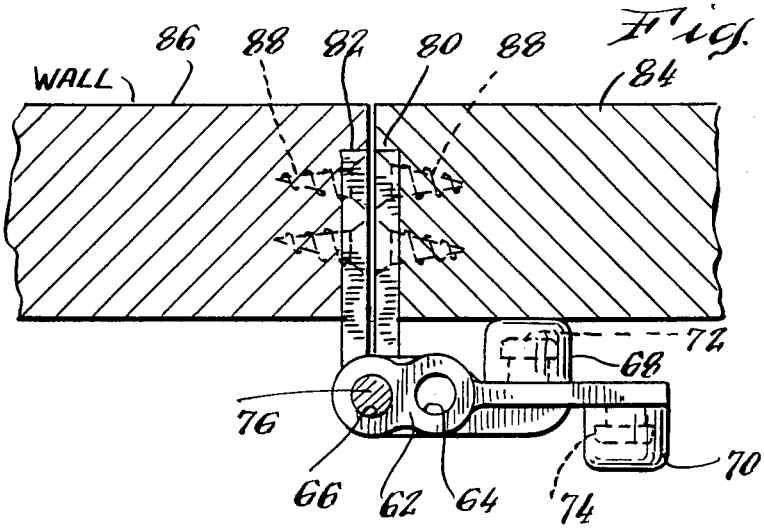
FIG. 11 shows a sectional view along the plane 11—11 of FIG. 10.
Figure 12:
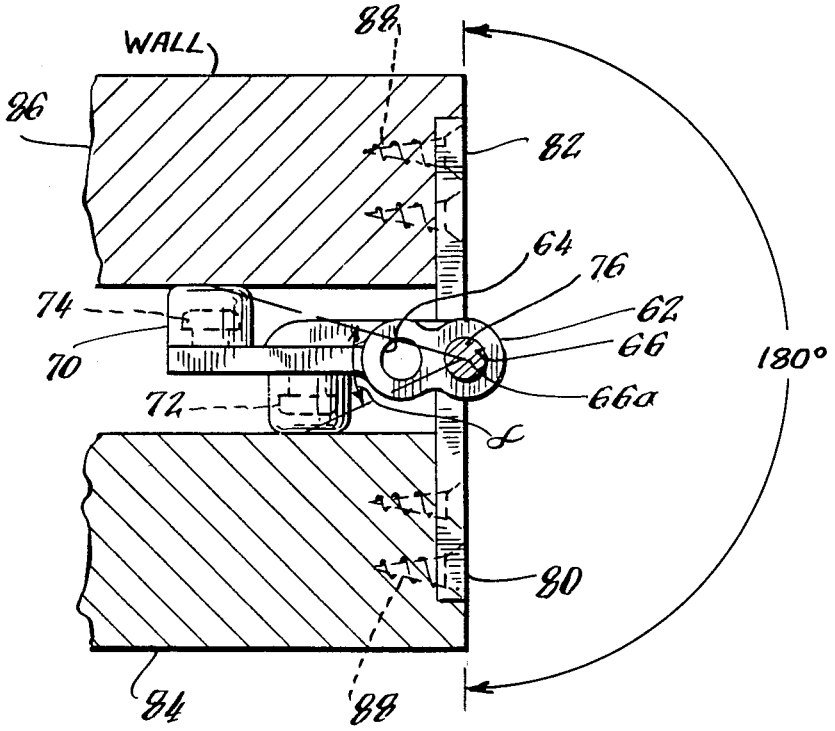
FIG. 12 shows the door shown in FIG. 11 opened 180 degrees with the door stop preventing further opening.
Figure 13:
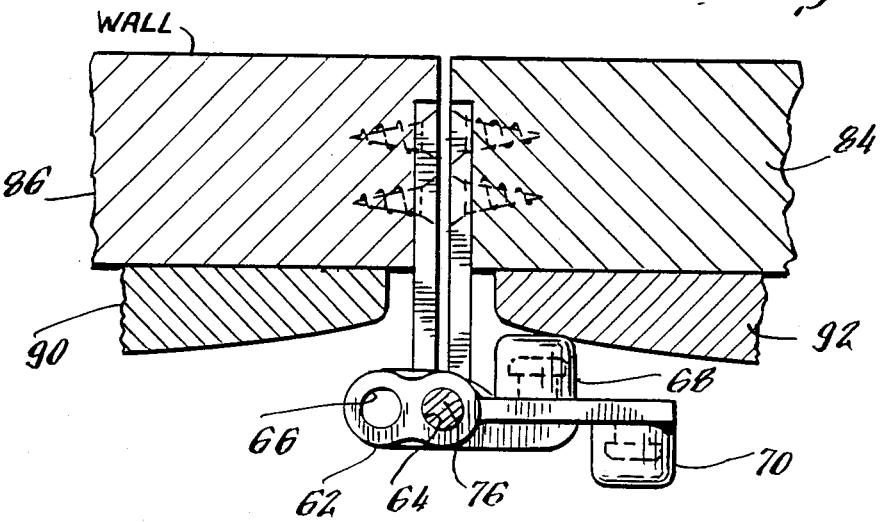
FIG. 13 shows a door stop as shown in FIG. 9 installed on a wall and door both having tapered molding.
Figure 14:
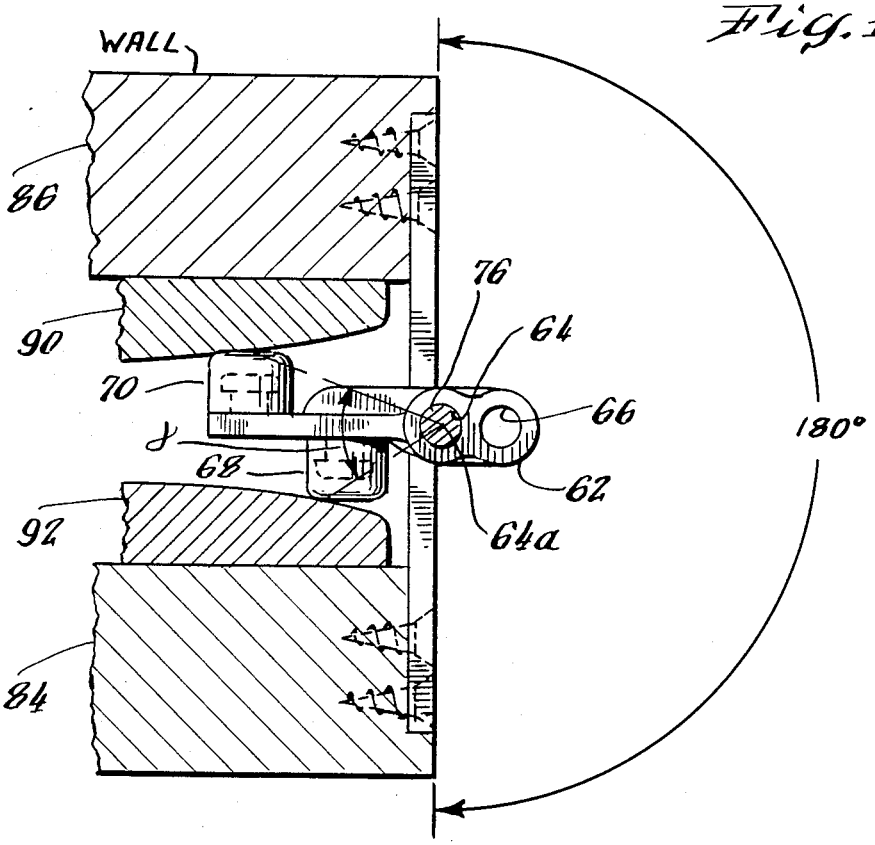
FIG. 14 shows the door and wall of FIG. 13 with the door opened 180 degrees and wherein the door stop prevents further opening of the door.

Referring to FIGS. 9 through 14, another embodiment of a door stop in accordance with the present invention is shown, and this door stop is particularly suited for permitting the door to open 180 degrees. Referring to the figures, the door stop includes a body 62. Apertures 64 and 66 are located at the other end of body 62, two bumpers 68 and 70 are mounted on protrusions 72 and 74. As shown in FIGS. 10–12, the door stop is mounted on a hinge pin 76 of hinge 78. Hinge plates 80 and 82 are mounted respectively to door 84 and wall 86 by a series of screws 88. As shown in FIGS. 10–12, the hinge pin 76 extends through aperture 66. As shown in FIG. 12, when the door is swung open against the wall, the angle between bumpers 68 and 70 and aperture axis 66*a* is alpha. As shown in FIGS. 13 and 14, when the door stop is mounted on the pin 76 through hole 64, the angle between axis 64*a* and bumpers 68 and 70 is gamma to permit use of the door stop on a door having tapered molding 80 and 82 and a hinge pin 76 that is located a relatively large distance from the door and the wall.

In addition, the door stop may be turned over to provide additional permutations of mounting in situations where either the wall or the door has a tapered molding, that is, in a situation similar to that type of door construction shown in FIGS. 5, 6, 7 and 8.

In summary, a door stop in accordance with the present invention has numerous advantages over prior art door stops. The door stop may be simply and easily manufactured. If desired, the door stop can have no moving parts and can be molded or formed in a single piece thereby reducing the manufacturing and material costs. A door stop in accordance with the present invention is reliable during use because there are no adjustment mechanisms to fail. Because the door stop has at least two apertures for mounting on the hinge pin, and the distance between the aperture axis and one bumper and the distance between the aperture axis and the other bumper are different, the door stop may be turned over to provide additional permutations for mounting on the hinge pin. Because of the relatively large number of ways in which the door stop may be placed on a hinge pin, almost every typical door construction may be accomodated by using a door stop in accordance with the present invention.

It should be understood that although specific embodiments of the invention have been described herein in detail, such description is for purposes of illustration only and modifications may be made thereto by those skilled in the art within the scope of the invention.

I claim:

1. A door stop for mounting on a hinge pin of a hinged door, the door stop comprising:

a body including at one end portion thereof at least two apertures for receiving said hinge pin, each aperture having an axis;

two bumpers secured with respect to said body, each bumper being spaced from the other bumper and the axis of each said aperture to define one angle between one said axis and said bumpers and another angle between another said axis and said bumpers to provide for multiple mounting positions of said door stop on said hinge pin.

2. A door stop according to claim 1 wherein one said bumper is spaced a greater distance from said axis of said one aperture than said other bumper.

3. A door stop according to claim 1 wherein said body comprises a single piece.

4. A door stop according to claim 1 wherein said body includes two protrusions upon which said bumpers are mounted, each protrusion including a generally cylindrical portion extending from the body and a button extending from said cylindrical portion, said bumper having a concavity for receiving said protrusion.

5. A door stop according to claim 1 wherein said bumpers are integral with said body.

6. A door stop according to claim 5 wherein each said bumper includes one elongate space open at one side of said bumper and another elongate space open at another side of said bumper, each said bumper forming a S-shaped coil compressible upon impact.

* * * * *